US010614973B2

(12) United States Patent
Seo

(10) Patent No.: US 10,614,973 B2
(45) Date of Patent: Apr. 7, 2020

(54) INTERLOCK APPARATUS FOR THREE CIRCUIT BREAKERS

(71) Applicant: LSIS CO., LTD., Anyang-si, Gyeonggi-do (KR)

(72) Inventor: Jae-Kwan Seo, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/946,365

(22) Filed: Apr. 5, 2018

(65) Prior Publication Data

US 2018/0294109 A1 Oct. 11, 2018

(30) Foreign Application Priority Data

Apr. 11, 2017 (KR) ..... 10-2017-0046867

(51) Int. Cl.
*H01H 9/26* (2006.01)

(52) U.S. Cl.
CPC ..... *H01H 9/262* (2013.01); *H01H 2009/265* (2013.01); *H01H 2009/267* (2013.01)

(58) Field of Classification Search
CPC ..... H01H 9/26; H01H 9/262; H01H 33/46; H01H 33/52; H01H 2009/265; H01H 2009/267
See application file for complete search history.

(56) References Cited

U.S. PATENT DOCUMENTS 6,388,214 B1 * 5/2002 Jones ..... H01H 9/262 200/5 B
2018/0294109 A1 * 10/2018 Seo ..... H01H 9/262

FOREIGN PATENT DOCUMENTS

| | | | |
|---|---|---|---|
| CN | 101101821 | A | 1/2008 |
| CN | 202373534 | U | 8/2012 |
| DE | 3841315 | A1 | 6/1989 |
| EP | 0856324 | A2 | 7/1998 |
| EP | 1204127 | A1 | 5/2002 |
| JP | 4237524 | B2 | 3/2009 |
| KR | 101082216 | B1 | 11/2011 |
| KR | 101768592 | B1 | 8/2017 |

OTHER PUBLICATIONS

European Search Report for related European Application No. 18165378.3; action dated Aug. 22, 2018; (8 pages).
Chinese Office Action for related Chinese Application No. 201810315253.6; action dated May 28, 2019; (6 pages).

* cited by examiner

*Primary Examiner* — Vanessa Girardi
(74) *Attorney, Agent, or Firm* — K&L Gates LLP

(57) ABSTRACT

An interlock apparatus according to embodiments is configured to block an operation of a third circuit breaker while a first circuit breaker and a second circuit breaker operate and include a mover and a rotator. The mover include a first connector connected to the first circuit breaker, a second connector connected to the second circuit breaker, and a central part disposed between the first connector and the second connector and is rectilinearly moved along one direction in response to operations of the first circuit breaker and the second circuit breaker. The rotator include a first engagement part engaged with to the third circuit breaker and a second engagement part engaged with the central part and be rotated around a shaft passing through the first engagement part.

7 Claims, 5 Drawing Sheets

INTERLOCK APPARATUS FOR THREE CIRCUIT BREAKERS

CROSS-REFERENCE TO RELATED APPLICATION

Pursuant to 35 U.S.C. § 119(a), this application claims the benefit of earlier filing date and right of priority to Korean Application No. 10-2017-0046867, filed on Apr. 11, 2017, the disclosure of which is incorporated herein by reference in its entirety.

BACKGROUND

1. Field of the Invention

The present invention relates to an interlock apparatus which is detachably attached to a circuit breaker.

2. Discussion of Related Art

Generally, a circuit breaker opens or closes a circuit. To this end, the circuit breaker is disposed at a circuit between a power source and loads. Further, the circuit breaker may connect circuits and may cut off the circuits. The circuit breaker may open or close a circuit in response to a manipulation of a user. Meanwhile, the circuit breaker may detect abnormal currents such as an overcurrent and a short-circuit current and may cut off a circuit.

Accordingly, a state change may occur in the circuit breaker. An interlock apparatus is detachably attached to the circuit breaker.

At this point, the interlock apparatus blocks an operation of a second circuit breaker while a first circuit breaker operates. Further, the interlock apparatus allows the second breaker to operate when the operation of the first breaker is stopped. For example, when the operation of the first breaker is stopped due to generation of an error or the like, the interlock apparatus may allow the second breaker to operate instead of the first breaker.

However, the above-described interlock apparatus blocks an operation of one of two circuit breakers and makes the one stand by for the other thereof. That is, until an operation of one of circuit breakers is stopped, the remaining circuit breakers should stand by without operating. Consequently, there is a problem in that utilization efficiency of the circuit breakers is low. Further, a relatively wide installation space is required for the circuit breakers.

SUMMARY OF THE INVENTION

The present invention is directed to an interlock apparatus capable of making one of circuit breakers stand by for remaining two or more of the circuit breakers. That is, the interlock apparatus can block an operation of one of three circuit breakers while the remaining two circuit breakers operate. Accordingly, utilization efficiency of circuit breakers can be improved. Further, an installation space required for circuit breakers can be reduced.

According to an aspect of the present invention, there is provided an interlock apparatus configured to block an operation of a third circuit breaker while a first circuit breaker and a second circuit breaker operate.

The interlock apparatus may include a first connector connected to the first circuit breaker, a second connector connected to the second circuit breaker, a central part disposed between the first connector and the second connector, a mover configured to be rectilinearly moved along one direction in response to the operations of the first circuit breaker and the second circuit breaker, a first engagement part engaged with the third circuit breaker, a second engagement part engaged with the central part, and a rotator configured to be rotated around a shaft passing through the first engagement part in response to a movement of the mover.

The mover may be rotated around a shaft passing through the central part in response to the operation of one of the first circuit breaker and the second circuit breaker.

The mover may be rectilinearly moved along the other direction to rotate the rotator in response to a stoppage of at least one of the first circuit breaker and the second circuit breaker.

The one direction and the other direction may be opposite to each other on an axis which vertically extends.

The interlock apparatus may further include an intermediator disposed between the third circuit breaker and the first engagement part, engaged with the first engagement part, and configured to be rotated together with the rotator and block a rotation of a rotating shaft of the third circuit breaker while the mover is moved in the one direction.

The intermediator may allow the rotation of the rotating shaft of the third circuit breaker while the mover is moved in the other direction.

The interlock apparatus may further include a base attached to the third circuit breaker, and a guide disposed to be rectilinearly movable at the base and engaged with at least one of the central part and the second engagement part.

The interlock apparatus may further include a first driver coupled to a rotating shaft of the first circuit breaker, connected to the first connector, and configured to be rotated in response to the operation of the first circuit breaker, and a second driver coupled to a rotating shaft of the second circuit breaker and configured to be rotated in response to the operation of the second circuit breaker.

The interlock apparatus may further include a first linker extending from the first driver, connected to the first connector, and configured to move the first connector in response to the operation of the first circuit breaker, and a second linker extending from the second driver, connected to the second connector, and configured to move the second connector in response to the operation of the second circuit breaker.

The interlock apparatus may further include a first coupler connected to the first circuit breaker, a second coupler connected to the second circuit breaker, and a driver including a shaft part coupled to the rotating shaft of the third circuit breaker between the first coupler and the second coupler.

The driver may be configured to be rotated together with the rotating shaft in response to the operation of the third circuit breaker.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
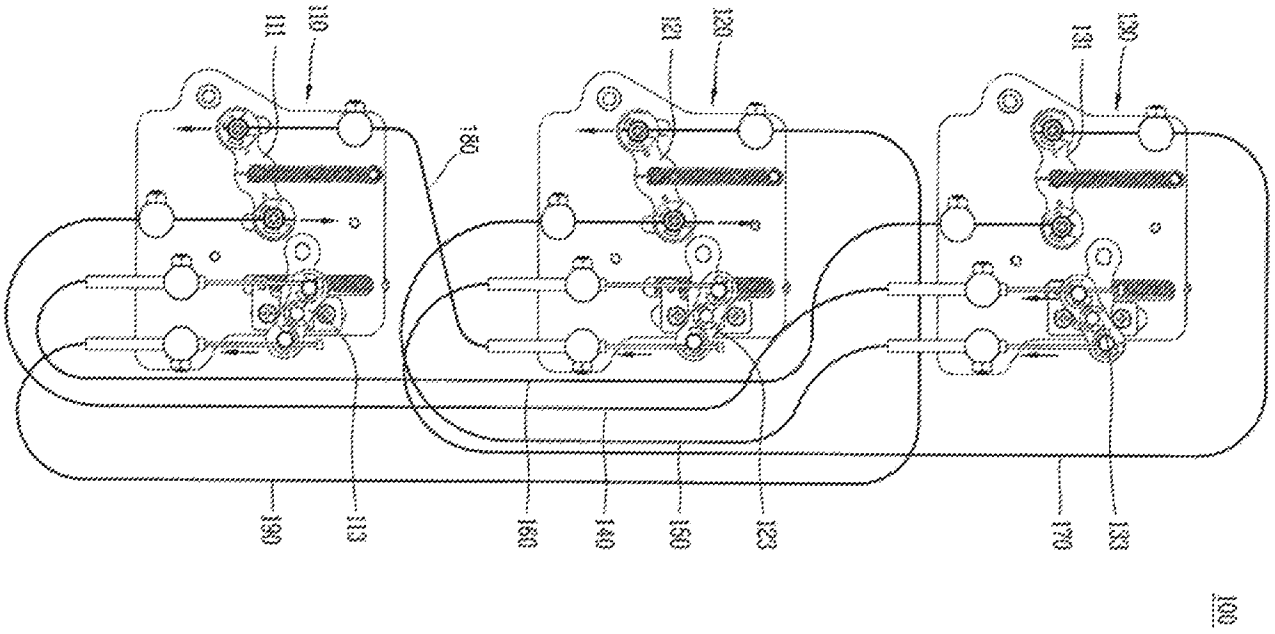
FIG. 1 is a front view of a system according to embodiments.

Hereinafter, embodiments of this disclosure will be described with reference to the accompanying drawings. However, it should be understood that techniques described in this disclosure are not intended to limit to a specific embodiment but include various modifications, equivalents, and/or alternatives. In the description of the drawings, similar reference numerals may be used for similar components. In this disclosure, the expression "have," "may have," "include," "may include," or the like means the presence of a corresponding feature, e.g., a numerical value, a function, an operation, or a component of parts and the like, and does not exclude the presence of additional features.

The terms used herein "first," "second," "third," and the like may refer to various components regardless of their order and/or importance, and these terms may be used for only distinguishing one component from other component and may not limit components.

Figure 2:
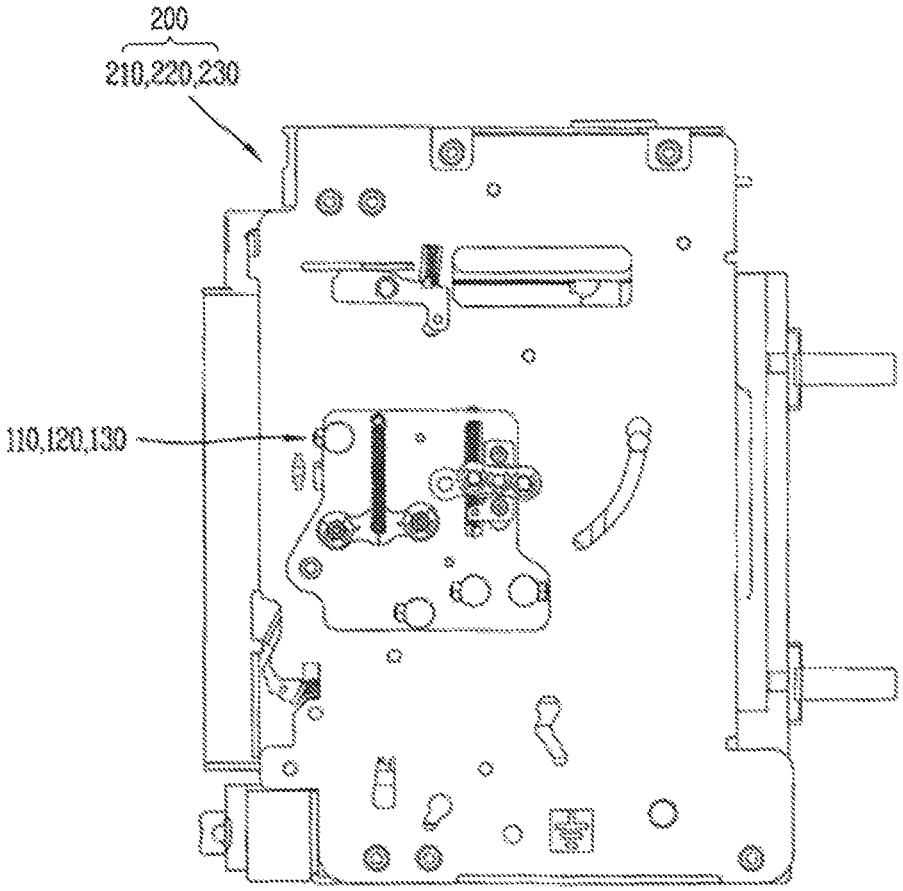
FIG. 2 is an exemplary diagram for describing the system according to the embodiments.

FIG. 1 is a front view of a system 100 according to embodiments. Further, FIG. 2 is an exemplary diagram for describing the system 100 according to the embodiments.

Referring to FIG. 1, the system 100 according to the embodiments may include three interlock apparatuses 110, 120, and 130 and six linkers 140, 150, 160, 170, 180, and 190.

The interlock apparatuses 110, 120, and 130 may be detachably attached to three circuit breakers 200. In this case, as shown in FIG. 2, the interlock apparatuses 110, 120, and 130 may be attached to an outside of circuit breakers 210, 220, and 230. The interlock apparatuses 110, 120, and 130 may include a first interlock apparatus 110, a second interlock apparatus 120, and a third interlock apparatus 130. The circuit breakers 210, 220, and 230 may include a first circuit breaker 210, a second circuit breaker 220, and a third circuit breaker 230. Here, the first interlock apparatus 110 may be attached to the first circuit breaker 210, the second interlock apparatus 120 may be attached to the second circuit breaker 220, and the third interlock apparatus 130 may be attached to the third circuit breaker 230.

The circuit breakers 210, 220, and 230 may open or close circuits. To this end, each of the circuit breakers 210, 220, and 230 may be disposed between a power source and a plurality of loads. For example, each of the circuit breakers 210, 220, and 230 may include an air circuit breaker. At this point, the circuit breakers 210, 220, and 230 may operate to connect the circuits. Meanwhile, operations of the circuit breakers 210, 220, and 230 may be stopped to cut off the circuits. Here, the circuit breakers 210, 220, and 230 may connect or cut off the circuits in response to a manipulation of a user. Meanwhile, the circuit breakers 210, 220, and 230 may detect abnormal currents such as an overcurrent and a short-circuit current and may cut off the circuits.

Thus, a state change may occur in each of the circuit breakers 210, 220, and 230. For example, switching between a circuit connection state and a circuit cut-off state may occur in the circuit breaker 210, 220, or 230. Here, a rotational shaft of the circuit breaker 210, 220, or 230 may be rotated according to the state change of the circuit breaker 210, 220, or 230. For example, when the circuit breaker 210, 220, or 230 is switched from a circuit connection state to a circuit cut-off state, the rotational shaft may be rotated in a clockwise direction. Meanwhile, when the circuit breaker 210, 220, or 230 is switched from the circuit cut-off state to the circuit connection state, the rotational shaft may be rotated in a counterclockwise direction.

According to the embodiments, the interlock apparatuses 110, 120, and 130 may make one of the circuit breakers 210, 220, and 230 stand by for the remaining two of the circuit breakers 210, 220, and 230. To this end, the interlock apparatuses 110, 120, and 130 may be coupled to the rotational shafts of the circuit breakers 210, 220, and 230, respectively. Further, the interlock apparatuses 110, 120, and 130 may be interconnected to cooperate. In this case, the interlock apparatuses 110, 120, and 130 may block an operation of the third circuit breaker 230 while the first circuit breaker 210 and the second circuit breaker 220 operate.

Here, the interlock apparatuses 110, 120, and 130 may block a rotation of the rotating shaft of the third circuit breaker 230. Meanwhile, the interlock apparatuses 110, 120, and 130 may allow the operation of the third circuit breaker 230 while the operation of the first circuit breaker 210 or the second circuit breaker 220 is stopped. Here, the interlock apparatuses 110, 120, and 130 may allow the rotation of the rotating shaft of the third circuit breaker 230.

Thus, one of the circuit breakers 210, 220, and 230 may stand by for the remaining two of the circuit breakers 210, 220, and 230. Here, the first circuit breaker 210 and the second circuit breaker 220 may connect circuits. While the first circuit breaker 210 and the second circuit breaker 220 operate, the third circuit breaker 230 may stand by without operating. Here, even when a user manipulates for an operation of the third circuit breaker 230, the third circuit breaker 230 may stand by without operating. Meanwhile, when the operation of either the first circuit breaker 210 or the second circuit breaker 220 is stopped, the third circuit breaker 230 may operate. At this point, the third circuit breaker 230 may operate on behalf of either the first circuit breaker 210 or the second circuit breaker 220. Here, the third circuit breaker 230 may operate in response to a manipulation of the user for the operation of the third circuit breaker 230. That is, the third circuit breaker 230 may connect the circuits together with either the first circuit breaker 210 or the second circuit breaker 220.

The first interlock apparatus 110 may include a first driver 111 and a first blocker 113. The first driver 111 may be coupled to the rotating shaft of the first circuit breaker 210 and may be rotated therewith in response to the operation of the first circuit breaker 210. The first blocker 113 may block the operation of the first circuit breaker 210 in response to the operations of the second circuit breaker 220 and the third circuit breaker 230. The second interlock apparatus 120 may include a second driver 121 and a second blocker 123. The second driver 121 may be coupled to the rotating shaft of the second circuit breaker 220 and may be rotated therewith in response to the operation of the second circuit breaker 220. The second blocker 123 may block the operation of the second circuit breaker 220 in response to the operations of the first circuit breaker 210 and the third circuit breaker 230. The third interlock apparatus 130 may include a third driver 131 and a third blocker 133. The third driver 131 may be coupled to the rotating shaft of the third circuit breaker 230 and may be rotated therewith in response to the operation of the third circuit breaker 230. The third blocker 133 may block the operation of the third circuit breaker 230 in response to the operations of the first circuit breaker 210 and the second circuit breaker 220.

The linkers 140, 150, 160, 170, 180, and 190 may connect the interlock apparatuses 110, 120, and 130. Further, each of the linkers 140, 150, 160, 170, 180, and 190 may linearly move between the interlock apparatuses 110, 120, and 130. At this point, two of the linkers 140, 150, 160, 170, 180, and 190 may extend from two of the interlock apparatuses 110, 120, and 130 and may be connected to the remaining one of the interlock apparatuses 110, 120, and 130. The linkers 140, 150, 160, 170, 180, and 190 may include a first linker 140, a second linker 150, a third linker 160, a fourth linker 170, a fifth linker 180, and a sixth linker 190.

According to the embodiments, the linkers 140, 150, 160, and 170 may make the interlock apparatuses 110, 120, and 130 share therebetween whether the circuit breakers 210, 220, and 230 operate. To this end, the linkers 140, 150, 160, and 170 may connect the first driver 111 and the second driver 121 to the third blocker 133, may connect the first driver 111 and the third driver 131 to the second blocker 123, and may connect the second driver 121 and the third driver 131 to the first blocker 113.

The first linker 140 may extend from the first driver 111 and may be connected to the third blocker 133. The second linker 150 may extend from the second driver 121 and may be connected to the third blocker 133. At this point, the first linker 140 and the second linker 150 may be connected to the third blocker 133 along the same direction on the basis of the third blocker 133.

The third linker 160 may extend from the third driver 131 and may be connected to the first blocker 113. The fourth linker 170 may extend from the third driver 131 and may be connected to the second blocker 123. At this point, the third linker 160 and the fourth linker 170 may extend from the third driver 131 along different directions on the basis of the third driver 131.

The fifth linker 180 may extend from the first driver 111 and may be connected to the second blocker 123. Here, the fourth linker 170 and the fifth linker 180 may be connected to the second blocker 123 along the same direction on the basis of the second blocker 123. Further, the first linker 140 and the fifth linker 180 may extend from the first driver 111 along different directions on the basis of the first driver 111. The sixth linker 190 may extend from the second driver 121 and may be connected to the first blocker 113. At this point, the third linker 160 and the sixth linker 190 may be connected to the first blocker 113 along the same direction on the basis of the first blocker 113. Further, the second linker 150 and the sixth linker 190 may extend from the second driver 121 along different directions on the basis of the second driver 121.

According to the embodiments, while the first circuit breaker 210 operates, the rotating shaft thereof may be rotated. Here, when the first circuit breaker 210 is switched from a circuit cut-off state to a circuit connection state, the rotating shaft of the first circuit breaker 210 may be rotated in the counterclockwise direction. Correspondingly, the first driver 111 in the first interlock apparatus 110 may be rotated together with the rotating shaft of the first circuit breaker 210. Here, the first driver 111 may be rotated in the counterclockwise direction. Consequently, the first driver 111 may pull the first linker 140. At this point, the first linker 140 may move from the third interlock apparatus 130 to the first interlock apparatus 110. Further, the first driver 111 may pull the fifth linker 180. At this point, the fifth linker 180 may move from the second interlock apparatus 120 to the first interlock apparatus 110.

According to the embodiments, when the second circuit breaker 220 operates, the rotating shaft thereof may be rotated. Here, when the second circuit breaker 220 is switched from a circuit cut-off state to a circuit connection state, the rotating shaft of the second circuit breaker 220 may be rotated in the counterclockwise direction. Correspondingly, the second driver 121 in the second interlock apparatus 120 may be rotated together with the rotating shaft of the second circuit breaker 220. Here, the second driver 121 may be rotated in the counterclockwise direction. Consequently, the second driver 121 may pull the second linker 150. At this point, the second linker 150 may move from the third interlock apparatus 130 to the second interlock apparatus 120. Further, the second driver 121 may pull the sixth linker 190. At this point, the sixth linker 190 may move from the first interlock apparatus 110 to the second interlock apparatus 120.

According to the embodiments, while the operation of the third circuit breaker 230 is stopped, the rotating shaft of the third circuit breaker 230 may be stationary. When the first circuit breaker 210 and the second circuit breaker 220 operate, the third blocker 133 may be rectilinearly moved by the first linker 140 and the second linker 150. Consequently, the third blocker 133 may block the operation of the third circuit breaker 230. That is, the third blocker 133 may block the rotation of the rotating shaft of the third circuit breaker 230. Meanwhile, when either the first circuit breaker 210 or the second circuit breaker 220 operates, the third blocker 133 may be rotated by either the first linker 140 or the second linker 150. Consequently, the third blocker 133 may allow the third circuit breaker 230 to operate. That is, the third blocker 133 may allow the rotation of the rotating shaft of the third circuit breaker 230.

According to the embodiments, while the first circuit breaker 210 and the second circuit breaker 220 operate, the rotational shafts of the first circuit breaker 210 and the second circuit breaker 220 are rotatable. That is, when the first circuit breaker 210 operates while the operation of the third circuit breaker 230 is stopped, the second blocker 123 may be rotated by the fifth linker 180. Consequently, the second blocker 123 may allow the second circuit breaker 220 to operate.

That is, the second blocker 123 may allow a rotation of the rotating shaft of the second circuit breaker 220. Meanwhile, when the second circuit breaker 220 operates while the operation of the third circuit breaker 230 is stopped, the first blocker 113 may be rotated by the sixth linker 190. Consequently, the first blocker 113 may allow the first circuit breaker 210 to operate. That is, the first blocker 113 may allow a rotation of the rotating shaft of the first circuit breaker 210.

Figure 3:
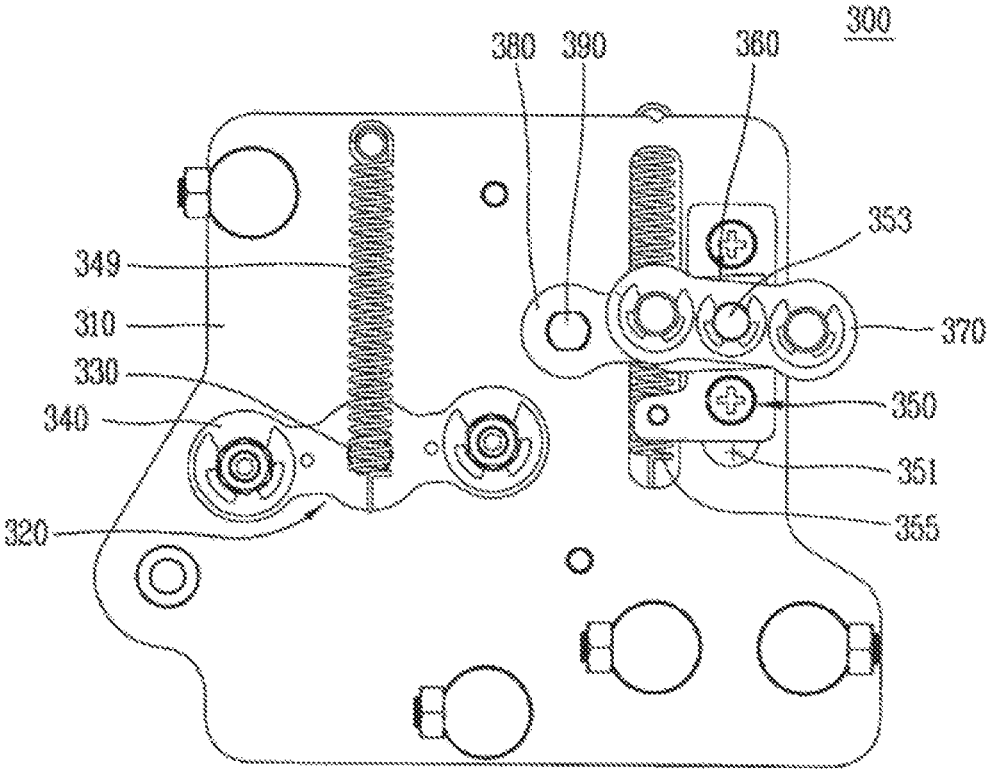
FIG. 3 is a front view of an interlock apparatus according to embodiments.

FIG. 3 is a front view of an interlock apparatus 300 according to embodiments.

Figure 4:
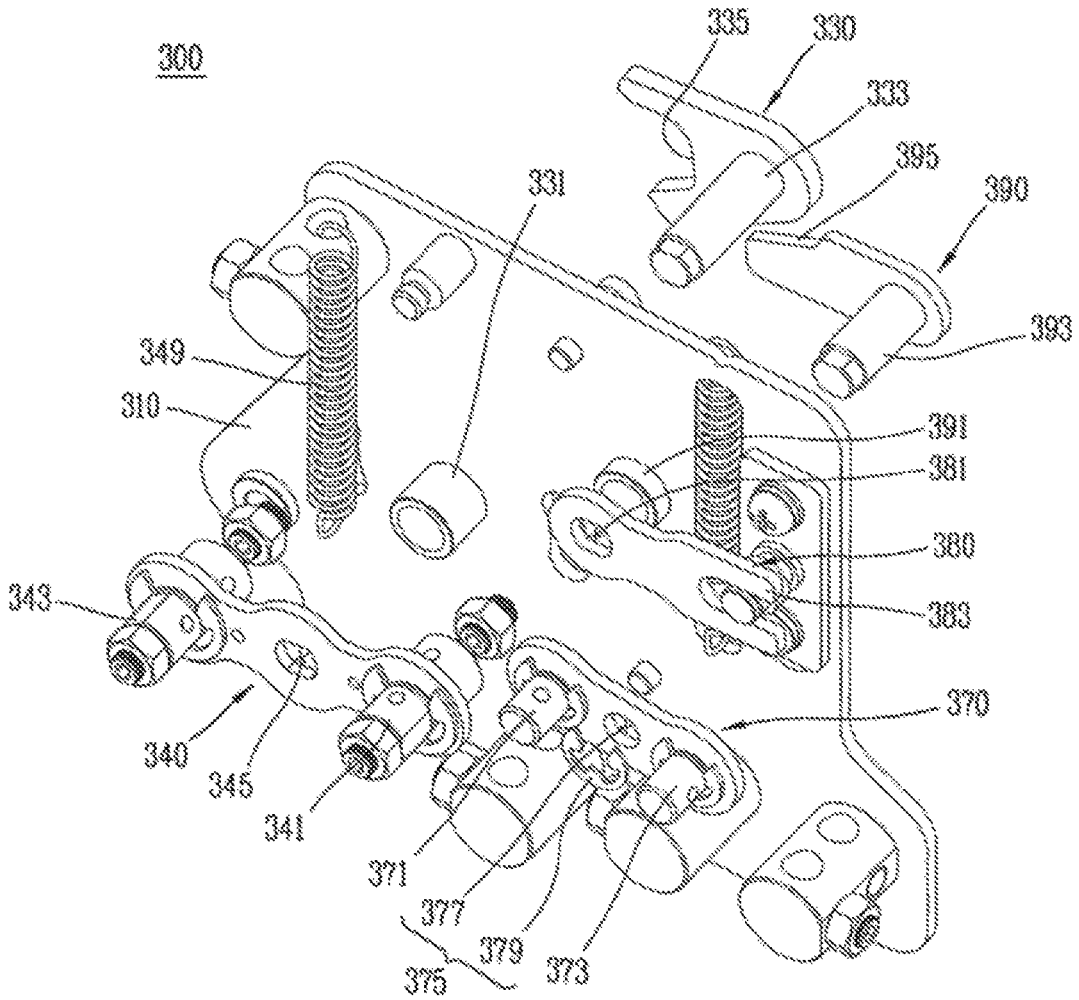
FIG. 4 is an exploded perspective view of the interlock apparatus according to the embodiments.

Further, FIG. 4 is an exploded perspective view of the interlock apparatus 300 according to the embodiments. Furthermore, FIG. 5 is a side view of the interlock apparatus 300 according to the embodiments.

Figure 5:
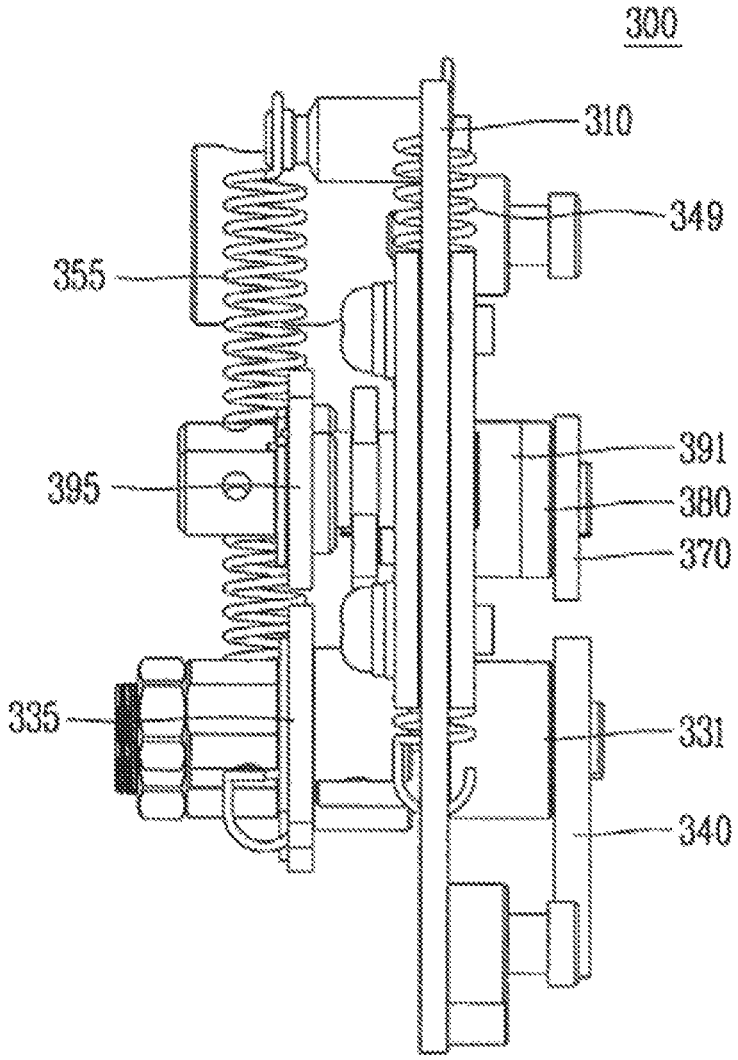
FIG. 5 is a side view of the interlock apparatus according to the embodiments.

Referring to FIGS. 3, 4 and 5, the interlock apparatus 300 according to the embodiments may include a base 310, a driver 320, a guide 350, and a blocker 360. At this point, the interlock apparatus 300 may be attached to the circuit breaker 210, 220, or 230 and may be connected to two different interlock apparatuses 300 attached to the remaining two of the circuit breakers 210, 220, and 230.

The base 310 may be attached to the circuit breaker 210, 220, or 230 of FIG. 2. At this point, the base 310 may be engaged with an outer enclosure of the circuit breaker 210, 220, or 230 outside the circuit breaker 210, 220, or 230. Further, the base 310 may support the driver 320, the guide 350, and the blocker 360.

The driver 320 may be coupled to the rotating shaft of the circuit breaker 210, 220, or 230. Further, the driver 320 may be rotated together with the rotating shaft in response to the operation and stoppage of the circuit breaker 210, 220, or 230. For example, when the circuit breaker 210, 220, or 230 is switched from a circuit connection state to a circuit cut-off state, the driver 320 may be rotated in a clockwise direction. Meanwhile, when the circuit breaker 210, 220, or 230 is switched from the circuit cut-off state to the circuit connection state, the driver 320 may be rotated in a counterclockwise direction. The driver 320 may include a first intermediator 330, a first rotator 340, and a first elastic part 349.

The first intermediator 330 may be installed between the base 310 and the circuit breaker 210, 220, or 230. Here, the first intermediator 330 may be disposed at a rear surface of the base 310. The first intermediator 330 may include a first insertion part 331, a first protrusion 333, and an accommodation part 335. The first insertion part 331 may pass through the base 310. For example, the first insertion part 331 may include a hole. The first protrusion 333 may be inserted into the first insertion part 331. Here, the first protrusion 333 may protrude from the rear surface of the base 310 to a front surface thereof. The accommodation part 335 may be coupled to the first protrusion 333 at the rear surface the base 310. Further, the accommodation part 335 may accommodate the rotating shaft of the circuit breaker 210, 220, or 230. Consequently, when the rotating shaft of the circuit breaker 210, 220, or 230 rotates, the first intermediator 330 may be rotated along the rotating shaft. That is, the accommodation part 335 may be rotated along the rotating shaft such that the first protrusion 333 may be rotated in the range within the accommodation part 335.

The first rotator 340 may be engaged with the first intermediator 330. Here, the first rotator 340 may be disposed at the front surface of the base 310. The first rotator 340 may include a first coupler 341, a second coupler 343, and a shaft part 345. The first coupler 341 and the second coupler 343 may be connected to another circuit breaker 210, 220, or 230. The shaft part 345 may be disposed between the first coupler 341 and the second coupler 343. Further, the shaft part 345 may be engaged with the first protrusion 333 of the first intermediator 330. Here, the shaft part 345 may accommodate the first protrusion 333. For example, the shaft part 345 may include a hole. Consequently, when the first intermediator 330 is rotated, the first rotator 340 may be rotated along the first protrusion 333.

The first elastic part 349 may be connected between the base 310 and the first rotator 340. At this point, one end portion of the first elastic part 349 may be fixed to the base 310 and the other end portion thereof may be connected to the first rotator 340. Here, the first elastic part 349 may be disposed at the front surface of the base 310. Further, the first elastic part 349 may have inherent elasticity. Consequently, the first elastic part 349 may provide a tensile force in response to a rotation of the first rotator 340.

The guide 350 may be disposed to be rectilinearly movable at the base 310. Further, the guide 350 may guide the blocker 360. The guide 350 may include a channel part 351, a protrusion 353, and a second elastic part 355. The channel part 351 may provide a movement path of the blocker 360. At this point, the channel part 351 may define a movable region of the blocker 360. Here, the channel part 351 may pass through the base 310. For example, the channel part 351 may include a hole.

The protrusion 353 may be engaged with the guide 350. Further, the protrusion 353 may be rectilinearly moved along the guide 350. Furthermore, the protrusion 353 may protrude to face the blocker 360.

The second elastic part 355 may be connected between the base 310 and the protrusion 353.

At this point, both end portions of the second elastic part 355 may be fixed to the base 310, and the protrusion 353 may be disposed between the both end portions of the second elastic part 355. Here, the second elastic part 355 may be disposed at the rear surface of the base 310, and at least a portion of the second elastic part 355 may be exposed to the front surface of the base 310. Further, the second elastic part 355 may have inherent elasticity. Consequently, the second elastic part 355 may provide a tensile force in response to a movement of the protrusion 353.

The blocker 360 may be engaged with the guide 350. Further, the blocker 360 may block the operation of the circuit breaker 210, 220, or 230. At this point, the blocker 360 may block the operation of the circuit breaker 210, 220, or 230 in response to an operation of another circuit breaker 210, 220, or 230. Here, the blocker 360 may block the rotation of the rotating shaft of the circuit breaker 210, 220, or 230. Consequently, even though a user manipulates for the operation of the circuit breaker 210, 220, or 230, the circuit breaker 210, 220, or 230 may not operate but stand by. Meanwhile, when an operation of another circuit breaker 210, 220, or 230 is stopped, the blocker 360 may allow the circuit breaker 210, 220, or 230 to operate. Here, the blocker 360 may allow the rotation of the rotating shaft of the circuit breaker 210, 220, or 230. Consequently, the circuit breaker 210, 220, or 230 may operate in response to the manipulation of the user for the operation of the circuit breaker 210, 220, or 230. The blocker 360 may include a mover 370, a second rotator 380, and a second intermediator 390.

The mover 370 may be engaged with the guide 350. Here, the mover 370 may be disposed at the front surface of the base 310. The mover 370 may include a first connector 371, a second connector 373, and a central part 375. The first connector 371 and the second connector 373 may be connected to another circuit breaker 210, 220, or 230. The central part 375 may be disposed between the first connector 371 and the second connector 373. Further, the central part 375 may be engaged with the protrusion 353 of the guide 350. For example, the central part 375 may include an accommodation hole 377 for accommodating the protrusion 355 and a fixing member 379 configured to prevent a separation between the accommodation hole 377 and the protrusion 355.

According to the embodiments, the mover 370 may be rotated around a shaft passing through the central part 375 in response to the operation of another circuit breaker 210, 220, or 230. That is, the mover 370 may be rotated in response to the protrusion 353. At this point, another circuit breaker 210, 220, or 230 pulls either the first connector 371 or the second connector 373 such that the mover 370 may be rotated. Further, the guide 350 may be stationary without being rectilinearly moved. For example, when the first connector 371 is pulled, the mover 370 may be rotated in the counterclockwise direction. Alternatively, when the second connector 373 is pulled, the mover 370 may be rotated in the clockwise direction.

According to the embodiments, the mover 370 may be rectilinearly moved along one direction in response to the operation of another circuit breaker 210, 220, or 230. At this point, another circuit breaker 210, 220, or 230 pulls all the first connector 371 and the second connector 373 such that the mover 370 may be rectilinearly moved along the one direction. Further, the mover 370 may rectilinearly move the guide 350 along the one direction. Here, the one direction may be defined on an axis which vertically extends. For example, the one direction may be a downward direction.

According to the embodiments, the mover 370 may be rectilinearly moved along the other direction in response to a stoppage of at least one of other circuit breakers 210, 220, and 230. At this point, the at least one of other circuit breakers 210, 220, and 230 pushes at least one of the first connector 371 and the second connector 373 such that the mover 370 may be rectilinearly moved along the other direction. Here, the mover 370 may be rectilinearly moved along the other direction as well as rotated in response to the stoppage of another circuit breaker 210, 220, or 230. Further, the mover 370 may rectilinearly move the guide 350 along the other direction. Here, the other direction may be defined on an axis which vertically extends and may be opposite the one direction. For example, the other direction may be an upward direction.

The second rotator 380 may be engaged with the circuit breaker 210, 220, or 230 and at least one of the guide 350 and the mover 370. Here, the second rotator 380 may be disposed at the front surface of the base 310. At this point, the second rotator 380 may be disposed at a rear surface of the mover 370. Alternatively, the second rotator 380 may be disposed at a front surface of the mover 370. The second rotator 380 may include a first engagement part 381 and a second engagement part 383. The first engagement part 381 may be engaged with the circuit breaker 210, 220, or 230. The second engagement part 383 may extend from the first engagement part 381 and may be engaged with at least one of the protrusion 353 of the guide 350 and the central part 375 of the mover 370. For example, the second engagement part 383 may branch off by interposing the protrusion 353 to accommodate the protrusion 353.

According to the embodiments, as the mover 370 is rectilinearly moved, the second rotator 380 may be rotated. At this point, the second engagement part 383 may be moved along the protrusion 353 of the guide 350 or the central part 375 of the mover 370 such that the second rotator 380 may be rotated. Further, the second rotator 380 may be rotated around a central axis of the first engagement part 381. For example, when the mover 370 is rectilinearly moved along one direction, the second rotator 380 may be rotated in the clockwise direction. Alternatively, when the mover 370 is rectilinearly moved along the other direction, the second rotator 380 may be rotated in the counterclockwise direction. Meanwhile, when the mover 370 is rotated without being rectilinearly moved, the second rotator 380 may be stationary without being rotated.

The second intermediator 390 may be installed between the circuit breaker 210, 220, or 230 and the base 310. Here, the second intermediator 390 may be disposed at the rear surface of the base 310. Further, the second intermediator 390 may be interposed between the circuit breaker 210, 220, or 230 and the second rotator 380. That is, the second intermediator 390 may engage the second rotator 380 with the circuit breaker 210, 220, or 230. The second intermediator 390 may include a second insertion part 391, a second protrusion 393, and a stopper 395. The second insertion part 391 may pass through the base 310. For example, the second insertion part 391 may include a hole. The second protrusion 393 may be inserted into the second insertion part 391. Here, the second protrusion 393 may protrude from the rear surface of the base 310 to the front surface thereof. Further, the second protrusion 393 may be engaged with the first engagement part 381 of the second rotator 380. The stopper 395 may be coupled to the second protrusion 393 at the rear surface of the base 310. Here, the stopper 395 may face the accommodation part 335 of the first intermediator 330. For example, the stopper 395 and the accommodation part 335 may be disposed on the same plane.

According to the embodiments, when the second rotator 380 is rotated, the second intermediator 390 may rotate together with the second rotator 380. At this point, as the second rotator 380 is rotated around the central axis of the first engagement part 381, the second intermediator 390 may be rotated around the central axis of the first engagement part 381. For example, when the second rotator 380 is rotated in the clockwise direction, the second intermediator 390 may be rotated in the clockwise direction. Alternatively, when the second rotator 380 is rotated in the counterclockwise direction, the second intermediator 390 may be rotated in the counterclockwise direction.

According to the embodiments, the second intermediator 390 may apply an input to the circuit breaker 210, 220, or 230 so as to block the operation thereof in response to the operation of another circuit breaker 210, 220, or 230. Here, when the circuit breaker 210, 220, or 230 includes an inputter for blocking an operation, the stopper 395 may apply an input to the inputter. Alternatively, the stopper 395 may be rotated along the second rotator 380 to come into contact with the accommodation part 335 of the first intermediator 330. Further, the stopper 395 may block the rotation of the accommodation part 335 of the first intermediator 330.

According to the embodiments, the second intermediator 390 may release the input for blocking an operation from the circuit breaker 210, 220, or 230 in response to the stoppage of at least one of other circuit breakers 210, 220, and 230. Here, when the circuit breaker 210, 220, or 230 includes the inputter for blocking an operation, the stopper 395 may release the input from the inputter. Alternatively, the stopper 395 may be rotated along the second rotator 380 and be separated from the accommodation part 335 of the first intermediator 330. Further, the stopper 395 may allow the rotation of the accommodation part 335 of the first intermediator 330.

In accordance with to the embodiments, the interlock apparatus may make one of first, second, and third circuit breakers stand by for the remaining two of the first to third circuit breakers. At this point, the interlock apparatus can block an operation of the third circuit breaker while the first and second circuit breakers operate. Consequently, even though a user manipulates for the operation of the third circuit breaker, the third breaker can stand by without operating. Further, the interlock apparatus may allow the third circuit breaker to operate when the operation of either the first circuit breaker or the second circuit breaker is stopped. Consequently, when the user manipulates for the operation of the third circuit breaker, the third breaker can operate on behalf of the first breaker or the second breaker. Therefore, utilization efficiency of the circuit breakers can be improved. Further, an installation space required for the circuit breakers can be reduced.

The terms herein are used for the purpose of describing only a specific embodiment and may not be intended to limit the scope of another embodiment. The singular forms include plural forms unless the context clearly notes otherwise. All terms including technical or scientific terms used herein have the same meanings as commonly understood by those skilled in the art to which the present invention pertains and described herein. Terms generally predefined in a dictionary among the terms used herein may be construed in the same or similar meanings as the contextual meanings of the related art and these terms are not intended to be construed as ideal or excessively formal meanings. In some cases, even though the terms are defined herein, these terms should not be construed as excluding the embodiments described herein.

What is claimed is:

1. An interlock apparatus configured to block an operation of a third circuit breaker while a first circuit breaker and a second circuit breaker operate, the interlock apparatus comprising:

a first connector connected to the first circuit breaker;

a second connector connected to the second circuit breaker;

a central part disposed between the first connector and the second connector;

a mover configured to be rectilinearly moved along one direction in response to the operations of the first circuit breaker and the second circuit breaker;

a first engagement part engaged with the third circuit breaker;

a second engagement part engaged with the central part;

a rotator configured to be rotated around a shaft passing through the first engagement part in response to a movement of the mover;

a base attached to the third circuit breaker; and a channel part providing a movement path of the mover and passing through the base, wherein the mover is rectilinearly moved along the other direction to rotate the rotator in response to a stoppage of at least one of the first circuit breaker and the second circuit breaker, wherein the interlock apparatus further comprises a second intermediator disposed between the third circuit breaker and the first engagement part, engaged with the first engagement part, and configured to be rotated together with the rotator, wherein the second intermediator comprises a stopper, wherein the second intermediator blocks a rotation of a first intermediator of the third circuit breaker in response to the stopper being rotated along the rotator to come into contact with an accommodation part of the first intermediator, and wherein the second intermediator allows the rotation of the first intermediator in response to the stopper being rotated along the rotator to be separated from the accommodation part of the first intermediator.

2. The interlock apparatus of claim 1, wherein the mover is rotated around a shaft passing through the central part in response to the operation of one of the first circuit breaker and the second circuit breaker.

3. The interlock apparatus of claim 1, further comprising:

a guide disposed to be rectilinearly movable at the base and engaged with at least one of the central part and the second engagement part.

4. The interlock apparatus of claim 1, wherein the one direction and the other direction are opposite to each other on an axis which vertically extends.

5. The interlock apparatus of claim 4, further comprising a driver including:

a first coupler connected to the first circuit breaker;

a second coupler connected to the second circuit breaker; and a shaft part coupled to a rotating shaft of the third circuit breaker between the first coupler and the second coupler, wherein the driver is configured to be rotated together with the rotating shaft in response to the operation of the third circuit breaker.

6. The interlock apparatus of claim 1, further comprising:

a first driver coupled to a rotating shaft of the first circuit breaker, connected to the first connector, and configured to be rotated in response to the operation of the first circuit breaker; and a second driver coupled to a rotating shaft of the second circuit breaker and configured to be rotated in response to the operation of the second circuit breaker.

7. The interlock apparatus of claim 6, further comprising:

a first linker configured to extend from the first driver, connected to the first connector, and configured to move the first connector in response to the operation of the first circuit breaker; and a second linker configured to extend from the second driver, connected to the second connector, and configured to move the second connector in response to the operation of the second circuit breaker.

* * * * *